US012535066B2

(12) United States Patent
Itahara et al.

(10) Patent No.: US 12,535,066 B2
(45) Date of Patent: Jan. 27, 2026

(54) DIAPHRAGM PUMP

(71) Applicant: Mabuchi Motor Oken Co., Ltd., Tokyo (JP)

(72) Inventors: Kazuki Itahara, Tokyo (JP); Shinnosuke Nozawa, Tokyo (JP)

(73) Assignee: MABUCHI MOTOR OKEN CO., LTD., Tokyo (JP)

( * ) Notice: Subject to any disclaimer, the term of this patent is extended or adjusted under 35 U.S.C. 154(b) by 27 days.

(21) Appl. No.: 18/366,432

(22) Filed: Aug. 7, 2023

(65) Prior Publication Data

US 2024/0044329 A1 Feb. 8, 2024

(30) Foreign Application Priority Data

Aug. 8, 2022 (JP) ..... 2022-126362

(51) Int. Cl.
*F04B 53/00* (2006.01)
*F04B 53/18* (2006.01)

(52) U.S. Cl.
CPC ..... *F04B 53/006* (2013.01); *F04B 53/18* (2013.01)

(58) Field of Classification Search
CPC .... F04B 53/006; F04B 53/18; F04B 43/0009; F04B 43/0045; F04B 43/02; F04B 43/025; F04B 43/026; F04B 43/04
See application file for complete search history.

(56) References Cited

U.S. PATENT DOCUMENTS 6,918,336 B1 * 7/2005 Makino ..... F04B 27/0808 92/79
2004/0148928 A1 * 8/2004 Makino ..... F04B 1/20 60/487
2013/0034452 A1 * 2/2013 Itahara ..... F04B 45/047 417/321

(Continued)

FOREIGN PATENT DOCUMENTS

CN 109098962 A 12/2018
JP 07-038679 U 7/1995

(Continued)

OTHER PUBLICATIONS

English Translation of JP2019183711A, generated from Espacenet on Mar. 7, 2025. (Year: 2025).*

(Continued)

*Primary Examiner* — Bryan M Lettman
(74) *Attorney, Agent, or Firm* — WOMBLE BOND DICKINSON (US) LLP

(57) ABSTRACT

A diaphragm pump includes a driving mechanism including a crank body fixed to the rotating shaft of a motor, a driving shaft that is fixed to the crank body and inclined, and a driving body rotatably supported by the driving shaft via a bearing member. The driving body includes a shaft portion that stores the bearing member, and an arm portion connected to the deformation portion of a diaphragm. The bearing member includes a first bearing member close to the crank body, a second bearing member spaced apart from the crank body, a shaft hole in which the driving shaft is rotatably fitted, and an oil reservoir formed at a boundary between the first and second bearing members. The shaft hole includes a through hole formed in the first bearing member, and a non-through hole formed in the second bearing member.

13 Claims, 11 Drawing Sheets

(56) References Cited

U.S. PATENT DOCUMENTS

| | | | | |
|---|---|---|---|---|
| 2015/0337816 | A1* | 11/2015 | Cai | F04B 17/03 417/375 |
| 2015/0337817 | A1* | 11/2015 | Cai | F04B 43/14 417/375 |
| 2015/0337819 | A1* | 11/2015 | Cai | F04B 53/14 417/375 |
| 2016/0108902 | A1* | 4/2016 | Cai | F04B 43/0045 417/273 |
| 2016/0108903 | A1* | 4/2016 | Cai | F04B 43/14 417/273 |
| 2018/0223828 | A1* | 8/2018 | Itahara | F04B 43/0063 |
| 2018/0363646 | A1* | 12/2018 | Inoue | F04B 43/0054 |
| 2020/0173433 | A1* | 6/2020 | Inoue | F04B 45/043 |
| 2021/0285436 | A1* | 9/2021 | Fukami | F04B 45/04 |
| 2023/0349372 | A1* | 11/2023 | Shirai | F04B 43/0063 |

FOREIGN PATENT DOCUMENTS

| | | | | |
|---|---|---|---|---|
| JP | 2003-035267 | A | | 2/2003 |
| JP | 4307867 | B2 | | 8/2009 |
| JP | 2019183711 | A | * | 10/2019 |
| JP | 7045058 | B2 | | 3/2022 |

OTHER PUBLICATIONS

European Search Report and Search Opinion received for European Application No. 23189989.9, mailed on Dec. 11, 2023, 9 pages.

* cited by examiner

PRIOR ART

DIAPHRAGM PUMP

BACKGROUND OF THE INVENTION

The present invention relates to a diaphragm pump including an oil reservoir that retains a lubricating oil in the bearing portion of a driving body configured to convert a rotation into a reciprocating motion.

A conventional diaphragm pump of this type is a diaphragm pump disclosed in Japanese Patent No. 7045058 (document 1). The diaphragm pump includes a crank body that is driven by a motor to rotate, a driving shaft that is fixed to the crank body and inclined, a driving body including a shaft portion rotatably supported by the driving shaft, and a diaphragm including a deformation portion that forms a pump chamber. The driving body includes an arm portion extending outward in the radial direction from the end portion of the shaft portion. The driving body converts the rotation of the motor into a reciprocating motion, and transfers the reciprocating motion from the arm portion to the deformation portion of the diaphragm.

The shaft portion of the driving body includes a recessed portion that is open toward the crank body, and a bearing member stored in the recessed portion. A through hole through which the driving shaft passes is formed in the bearing member, and a shaft hole serving as a non-through hole in which the distal end portion of the driving shaft is fitted is formed at the central portion of the bottom surface of the recessed portion. An oil reservoir that retains a lubricating oil is formed at the boundary between the bottom surface of the recessed portion and the bearing member.

The diaphragm pump disclosed in document 1 has the following two problems with the bearing portion of the driving body.

The first problem is that coaxial adjustment is necessary between the shaft hole formed in the driving body and the recessed portion storing the bearing member, and this adjustment takes a long time. The coaxial adjustment of the driving body is work of positioning the axes of the shaft hole and bearing member on the same axis. The coaxial adjustment is important because the load at the time of rotation can be reduced by positioning the shaft hole and the bearing member on the same axis.

The coaxial adjustment is performed by machining a mold, and executed on a mold for forming the bearing member in addition to a mold for molding the driving body. The coaxial adjustment of the mold for molding the driving body includes work of adjusting the hole diameter of the shaft hole, work of adjusting the recess diameter of the recessed portion, and work of aligning the shaft hole and the recessed portion. The coaxial adjustment of the mold for forming the bearing member includes work of adjusting the inner diameter and outer diameter of the bearing member, and work of aligning the inner surface and outer surface of the bearing member.

The coaxial adjustment of the driving body is executed every time an update mold is formed, a mold is remodeled or modified, or the mold of another driving body (driving body different in material, the number of cylinders, or the like) to which the same bearing member is diverted is formed. The bearing member is smaller than the driving body. The mold for forming the bearing member is formed so that a plurality of bearing members can be molded simultaneously. When driving bodies and bearing members are produced by the same number, the mold for molding the driving body needs to be updated earlier than the mold for molding the bearing member. Since the number of times at which the coaxial adjustment is executed on the mold for molding the driving body becomes larger, it is necessary to simplify and easily execute the adjustment work on the mold for molding the driving body.

The second problem is that the wear resistance of the shaft hole formed in the driving body is low. The driving body disclosed in document 1 is formed as shown in FIG. 10. A driving body 1 shown in FIG. 10 includes a shaft hole 2 at the central portion, and three arm portions 3 radially extending from the shaft hole 2. The shaft hole 2 is a hole in which the distal end portion of a driving shaft (not shown) is rotatably fitted. A through hole 4 in which a coupling piece (not shown) provided for each deformation portion of the diaphragm is inserted is formed at the distal end portion of each arm portion 3.

The shaft hole 2 is formed at almost the same position as that of the arm portion 3 in the axial direction of the driving shaft. Around the shaft hole 2, there are thick portions 5 that continue to the arm portions 3 and are relatively thick, and thin portions 6 that exist between the arm portions 3 and are relatively thin. At the thick portions 5, many sink marks are generated at the time of molding the driving body 1, compared to the thin portions 6. At the time of molding, sink marks are nonuniformly generated around the shaft hole 2. If the sink marks around the shaft hole 2 are nonuniform, the circularity of the shaft hole 2 readily drops, the clearance between the hole wall surface of the shaft hole 2 and the driving shaft becomes excessively narrow, and the oil film between the shaft hole 2 and the driving shaft may break. At the portion where the oil film breaks, the wear proceeds and the wear resistance of the shaft hole 2 drops, as described above.

SUMMARY OF THE INVENTION

It is an object of the present invention to provide a diaphragm pump in which adjustment work executed on a mold for molding a driving body is simplified and the wear resistance of a bearing portion is improved.

To achieve the above object, according to one aspect of the present invention, there is provided a diaphragm pump comprising a diaphragm including a deformation portion constituting part of a wall of a pump chamber, a crank body fixed to a rotating shaft of a motor, a driving shaft that is fixed at an eccentric position of the crank body and inclined, a driving body that is rotatably supported by the driving shaft via a bearing member and configured to convert a rotation of the crank body into a reciprocating motion and transfer the reciprocating motion to the deformation portion, and a pump mechanism configured to alternately repeat a state in which a fluid is exhausted from the pump chamber and a state in which the fluid is sucked into the pump chamber along with the reciprocating motion of the driving body, the driving body including a shaft portion configured to store and hold the bearing member in a fitted state, and an arm portion that projects outward in a radial direction from the shaft portion and is connected to the deformation portion, and the bearing member including a first bearing member and a second bearing member superimposed on each other in a state in which the first bearing member and the second bearing member are aligned in an axial direction of the driving shaft, the first bearing member being closer to the crank body than the second bearing member, a shaft hole configured to rotatably fit the driving shaft, the shaft hole including a through hole formed in the first bearing member and a non-through hole formed in the second bearing member, and an oil reservoir formed at a boundary between the first bearing member and the second bearing member.

DESCRIPTION OF THE PREFERRED EMBODIMENT

A diaphragm pump according to an embodiment of the present invention will be described in detail with reference to FIGS. 1 to 8B.

Figure 1:
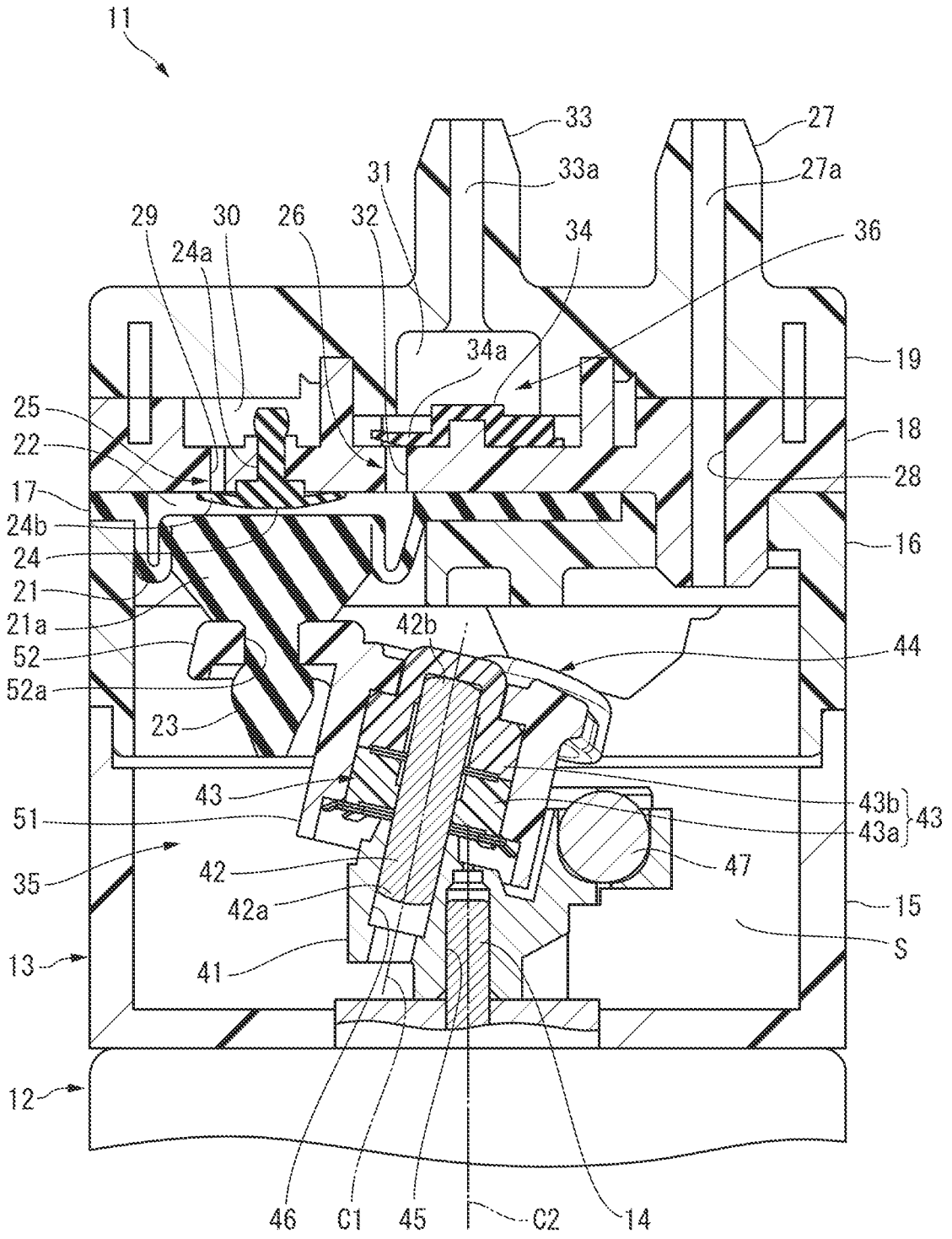
FIG. 1 is a sectional view of a diaphragm pump according to an embodiment of the present invention.

A diaphragm pump 11 shown in FIG. 1 is attached to a motor 12 at the lowest position in FIG. 1, and driven by the motor 12 to operate. The diaphragm pump 11 according to the embodiment is a pump that sucks and exhausts air.

The diaphragm pump 11 includes a housing 13 fixed to the motor 12. Functional components constituting the diaphragm pump 11 are held by the housing 13.

Housing

The housing 13 is formed into a columnar shape by combining a plurality of members in the axial direction of the motor 12, and is positioned on the same axis as that of a rotating shaft 14 of the motor 12. The plurality of members constituting the housing 13 are a bottom body 15 of a bottomed cylindrical shape attached to the motor 12, a diaphragm holder 16 attached to the opening portion of the bottom body 15, a disk-like valve holder 18 attached to the diaphragm holder 16 in a state in which a diaphragm 17 (to be described later) is sandwiched between the valve holder 18 and the diaphragm holder 16, and a lid body 19 so attached as to overlap the valve holder 18.

The diaphragm 17 is held between the diaphragm holder 16 and the valve holder 18. The diaphragm 17 has a plurality of cup-like deformation portions 21 that are open toward the valve holder 18. The deformation portions 21 are provided at positions where they divide the diaphragm 17 into a plurality of parts in the circumferential direction of the housing 13. Three deformation portions 21 according to the embodiment are respectively provided at positions where they divide the housing 13 into three equally in the circumferential direction.

The opening portion of each deformation portion 21 is closed by the valve holder 18. A pump chamber 22 is formed between the deformation portion 21 and the valve holder 18. The deformation portion 21 constitutes part of the wall of the pump chamber 22. A coupling piece 23 projecting in a direction opposite to the pump chamber 22 is provided on a bottom wall 21*a* of the cup-like deformation portion 21.

Pump Mechanism

At a portion of the valve holder 18 that constitutes the wall of the pump chamber 22, a suction valve 24 is provided, and a suction passage 25 and an exhaust passage 26 are open. The suction valve 24 is formed from a rubber material and is provided for each pump chamber 22. The suction valve 24 according to the embodiment includes a shaft portion 24*a* that passes through the valve holder 18 and is fixed to the valve holder 18, and a valve body 24*b* in tight contact with a wall surface of the valve holder 18 on the pump chamber 22 side.

The suction passage 25 is formed by connecting a plurality of holes, a space, and the like. The upstream end of the suction passage 25 according to the embodiment is constituted by a suction pipe 27 provided at the peripheral portion of the lid body 19. An internal passage 27*a* of the suction pipe 27 communicates with a space S in the diaphragm holder 16 via a first through hole 28 of the valve holder 18. The downstream end of the suction passage 25 is constituted by a second through hole 29 open in the pump chamber 22 through the valve holder 18.

The second through hole 29 makes the pump chamber 22 communicate with a suction fluid chamber 30 formed between the valve holder 18 and the lid body 19. The suction fluid chamber 30 is connected to the above-mentioned space S via a fluid channel (not shown). The suction fluid chamber 30 is formed into an annular shape on the same axis as that of the housing 13 and communicates with each pump chamber 22 via the second through hole 29 of the pump chamber 22, details of which are not shown. The opening portion of the second through hole 29 on the pump chamber 22 side is closed by the valve body 24*b* of the suction valve 24.

The exhaust passage 26 is constituted by an exhaust fluid chamber 31 formed at the shaft center portion of the housing 13 between the valve holder 18 and the lid body 19, a third through hole 32 formed in the valve holder 18 so that the exhaust fluid chamber 31 and the pump chamber 22 communicate with each other, and an exhaust pipe 33 formed at the shaft center portion of the lid body 19. An internal space 33*a* of the exhaust pipe 33 communicates with the exhaust fluid chamber 31. An exhaust valve 34 is provided in the exhaust fluid chamber 31. The exhaust valve 34 includes a valve body 34*a* that is formed from a rubber material and is in tight contact with a wall surface of the valve holder 18 on the exhaust fluid chamber 31 side. The valve body 34*a* closes the opening portion of the third through hole 32.

The exhaust valve 34 and the above-described suction valve 24 are opened/closed along with an increase/decrease of the volume of the pump chamber 22. The exhaust valve 34 is opened in the contraction process in which the volume of the pump chamber 22 decreases, and is closed in the remaining time. The suction valve 24 is opened in the expansion process in which the volume of the pump chamber 22 increases, and is closed in the remaining time. The volume of the pump chamber 22 changes as the deformation portion 21 of the diaphragm 17 is pushed and pulled by a driving mechanism 35 (to be described later).

In the embodiment, a pump mechanism 36 is constituted by the suction valve 24, the exhaust valve 34, the suction pipe 27, the first through hole 28, the space S, the fluid channel (not shown), the suction fluid chamber 30, the second through hole 29, the third through hole 32, the exhaust fluid chamber 31, the exhaust pipe 33, and the like.

Driving Mechanism

The driving mechanism 35 includes a crank body 41 attached to the rotating shaft 14 of the motor 12, a driving shaft 42 that is fixed to an eccentric position of the crank body 41 and inclined, and a driving body 44 rotatably supported by the driving shaft 42 via a bearing member 43.

A first shaft hole 45 serving as a non-through hole, and a second shaft hole 46 serving as a through hole are formed in the crank body 41, and a vibration suppression counterweight 47 is provided on the crank body 41. The first shaft hole 45 is formed at the shaft center portion of the crank body 41, and is open on the lower surface of the crank body 41. The second shaft hole 46 is inclined in a predetermined direction with respect to the first shaft hole 45, and is open at an eccentric position on the upper surface of the crank body 41. The second shaft hole 46 and the counterweight 47 are arranged at positions where they sandwich the first shaft hole 45.

The rotating shaft 14 is press-fitted in the first shaft hole 45. The crank body 41 is fixed to the rotating shaft 14 and rotates together with the rotating shaft 14. A first end portion 42*a* of the driving shaft 42 is press-fitted in the second shaft hole 46. The driving shaft 42 is supported by the crank body 41 in a state in which the first end portion 42*a* of the driving shaft 42 is fixed at a portion of the crank body 41 eccentric to the rotating shaft 14, and an axis C1 of the driving shaft 42 is inclined in a predetermined direction with respect to an axis C2 of the rotating shaft 14. The direction in which the driving shaft 42 is inclined is a direction in which the eccentric amount of a second end portion 42*b* of the driving shaft 42 with respect to the rotating shaft 14 decreases.

Figure 2:
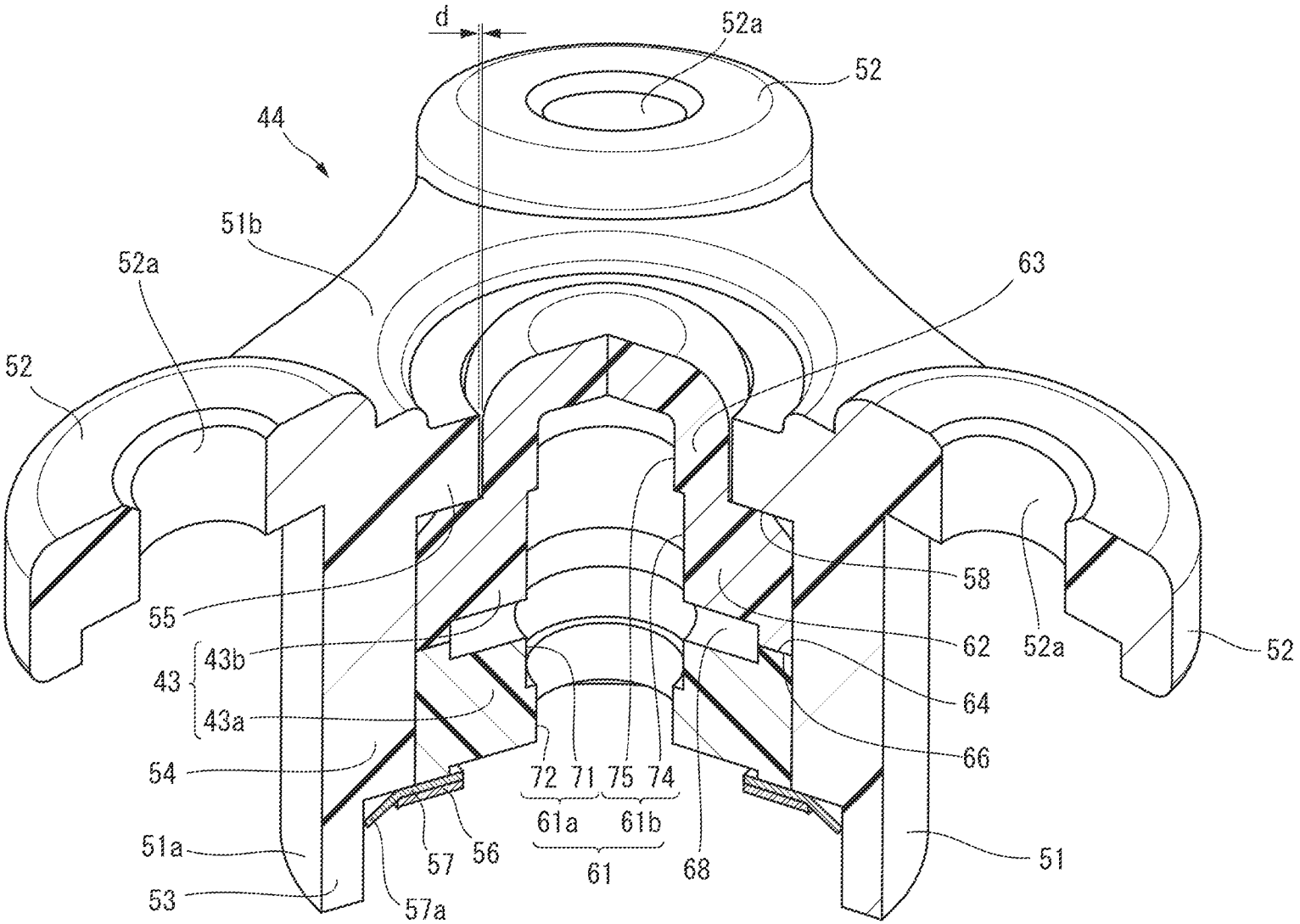
FIG. 2 is a perspective sectional view of a driving body in which a bearing member is assembled.
Figure 3:
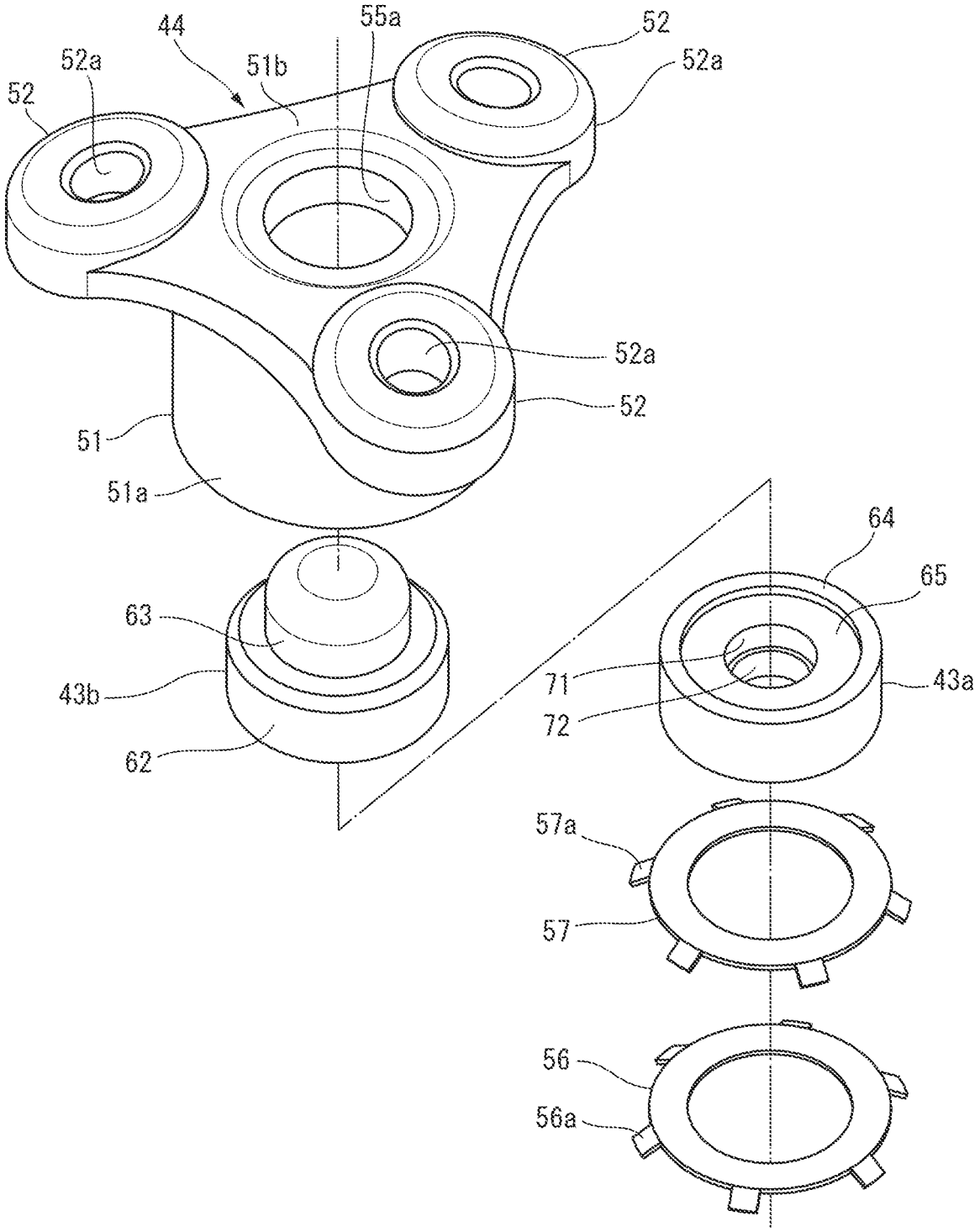
FIG. 3 is an exploded perspective view of the driving body and the bearing member.
Figure 4:
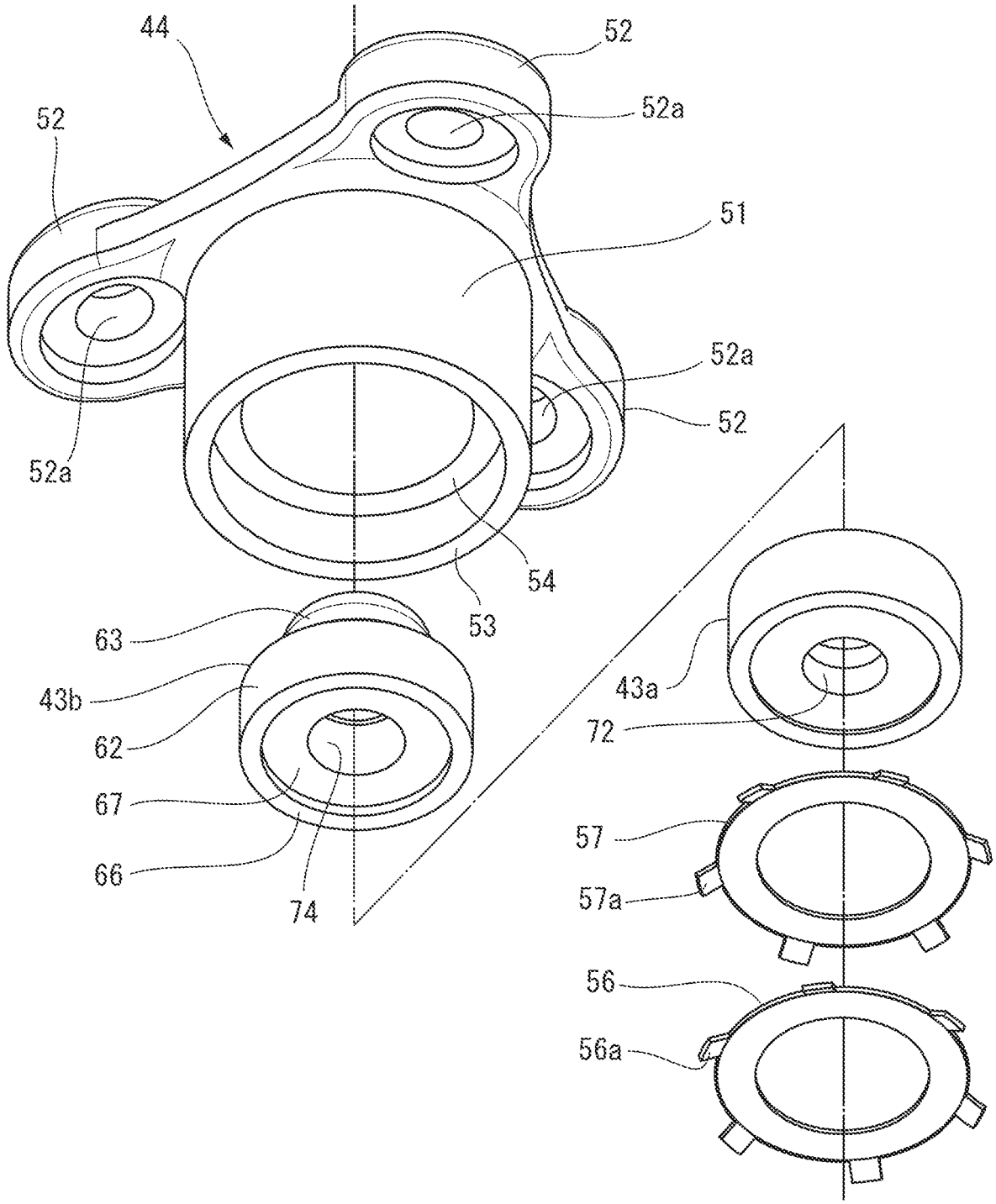
FIG. 4 is an exploded perspective view of the driving body and the bearing member.

As shown in FIGS. 2 to 4, the driving body 44 includes a shaft portion 51 that stores and holds the bearing member 43 (to be described later) in a fitted state, and three arm portions 52 projecting outward in the radial direction from the shaft portion 51. The shaft portion 51 includes a first end portion 51*a* close to the crank body 41, and a second end portion 51*b* spaced apart from the crank body 41 in comparison with the first end portion 51*a*. The arm portions 52 are connected to the second end portion 51*b*. In other words, the arm portions 52 are formed integrally with the end portion 51*b* of the shaft portion 51 on a side opposite to the crank body 41, and radially extend in three directions from the shaft portion 51. A through hole 52*a* through which the coupling piece 23 provided on each deformation portion 21 of the above-described diaphragm 17 is inserted is formed at the distal end portion of each arm portion 52.

Figure 5A:
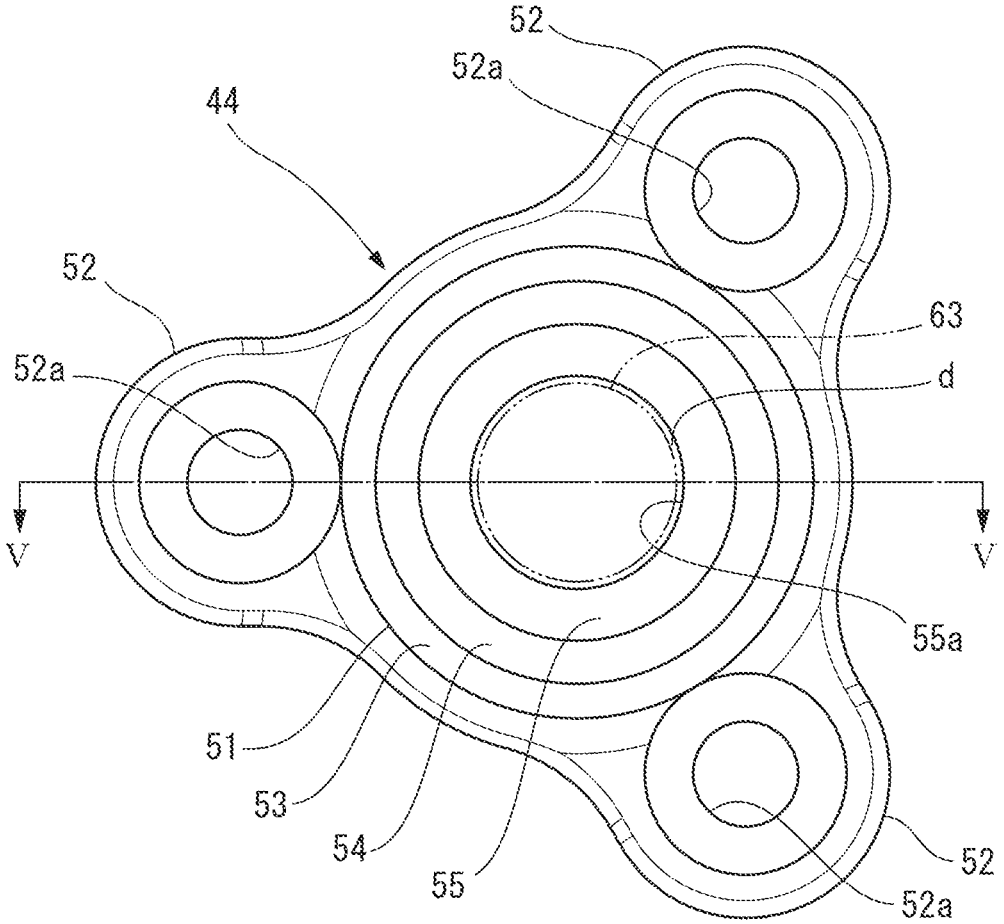
FIG. 5A is a bottom view of the driving body.
Figure 5B:
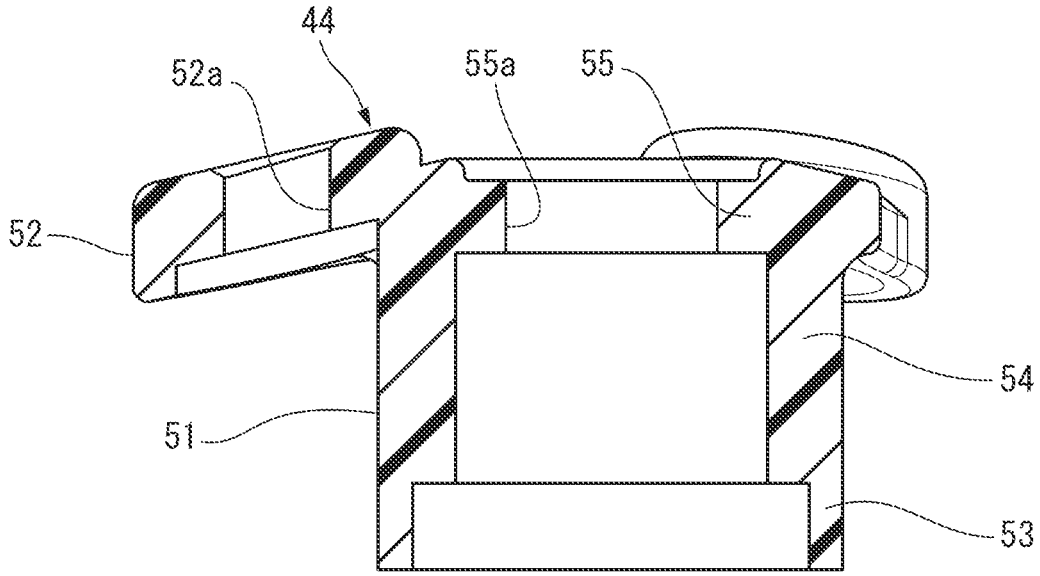
FIG. 5B is a sectional view of the driving body.

The shaft portion 51 is formed into a cylindrical shape open at two ends by using a mold (not shown) for molding the driving body 44. As shown in FIGS. 2, 5A, and 5B, the shaft portion 51 includes first to third portions 53 to 55 aligned in the axial direction. FIG. 5A is a bottom view of the driving body 44, and FIG. 5B is a sectional view taken along a line V-V in FIG. 5A.

The first portion 53 includes the first end portion 51*a* close to the crank body 41. The first portion 53 has a function of storing ring-like latch members 56 and 57. The two latch members 56 and 57 are mounted at the first portion 53 according to the embodiment in a state in which they overlap each other in the axial direction of the shaft portion 51. The latch members 56 and 57 have a ring shape, and include many (plurality of) elastic claw pieces 56*a* and 57*a* (see FIGS. 3 and 4) that press the inner surface of the first portion 53 outward in the radial direction. The latch members 56 and 57 are fixed to the first portion 53 by a frictional force generated by pressing the inner surface of the first portion 53 by the elastic claw pieces 56*a* and 57*a*.

The second portion 54 is provided at the central portion in the axial direction of the shaft portion 51, and arranged between the first portion 53 and the third portion 55. The second portion 54 has a function of storing the bearing member 43 (to be described later) in a fitted state. The inner diameter of the second portion 54 is smaller than that of the first portion 53. The above-mentioned latch members 56 and 57 prevent the bearing member 43 from detaching from the second portion 54 to the first portion 53.

The third portion 55 includes the second end portion 51*b* spaced apart from the crank body 41. The third portion 55 has a function of connecting the shaft portion 51 and the arm portions 52 of the driving body 44. That is, the arm portions 52 are connected to the third portion 55. The inner diameter of the third portion 55, that is, the inner diameter of an opening 55*a* is smaller than that of the second portion 54. The third portion 55 includes, at the boundary between the second portion 54 and the third portion 55, a ring-like end face 58 almost orthogonal to the axis of the driving shaft 42. The third portion 55 (second end portion 51*b*) includes an opening 55*a* to which a small-diameter portion 63 of a second bearing member 43*b* (to be described later) is inserted.

Bearing Member

As shown in FIG. 2, the bearing member 43 includes a first bearing member 43*a* and the second bearing member 43*b* that overlap each other in a state in which they are aligned in the axial direction (vertical direction in FIG. 2) of the driving shaft 42. The first bearing member 43*a* is arranged at a position closer to the crank body 41 than the second bearing member 43*b*. The first bearing member 43*a* and the second bearing member 43*b* are formed into a columnar shape by a plastic material.

Figure 6A:
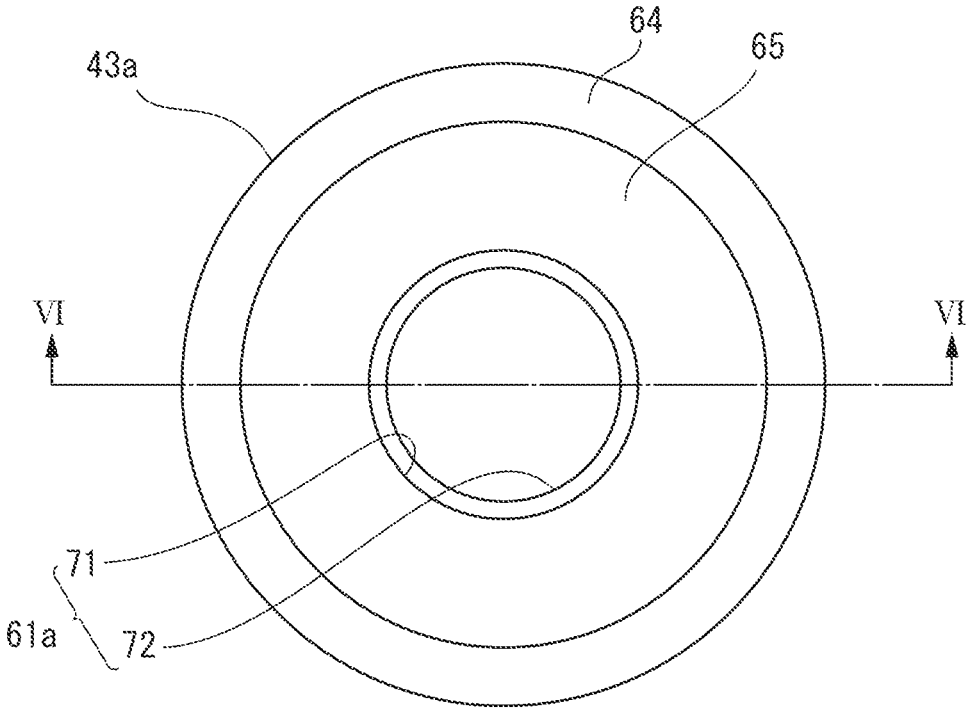
FIG. 6A is a plan view of a first bearing member.
Figure 6B:
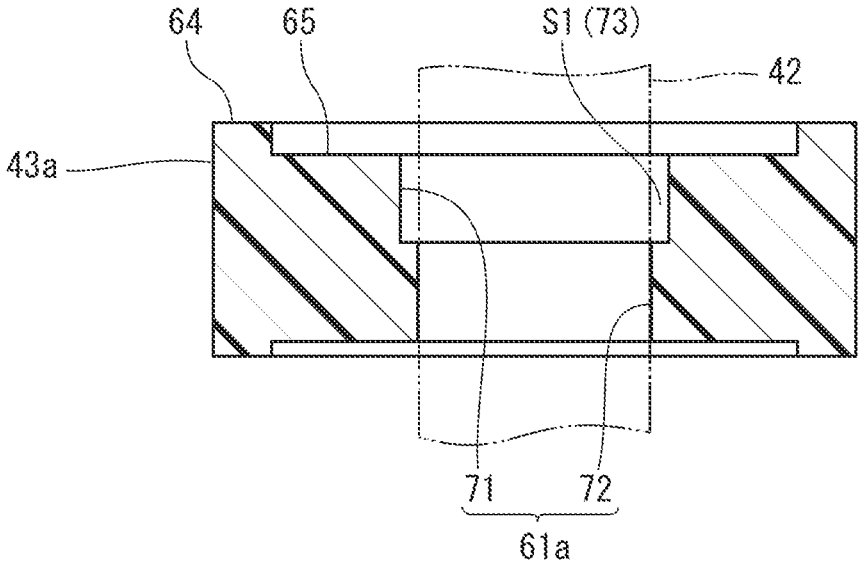
FIG. 6B is a sectional view of the first bearing member.
Figure 7A:
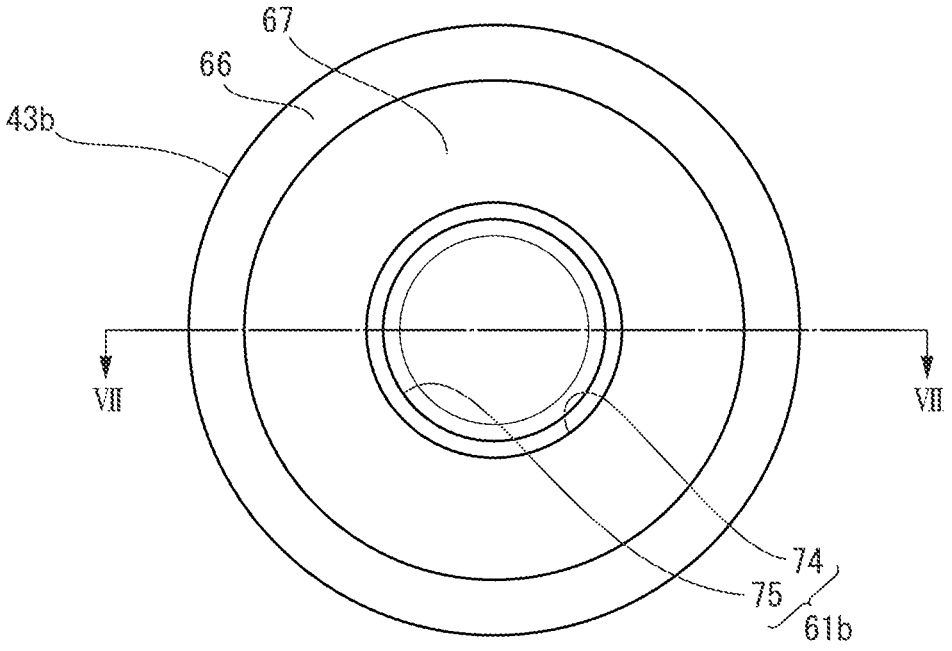
FIG. 7A is a bottom view of a second bearing member.
Figure 7B:
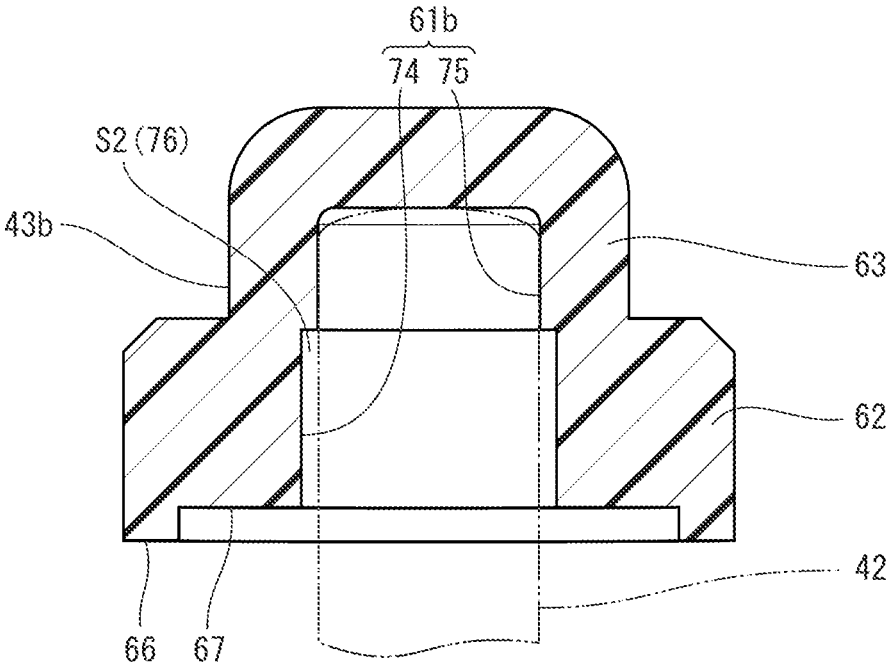
FIG. 7B is a sectional view of the second bearing member.

A shaft hole 61 in which the driving shaft 42 is rotatably fitted is formed in the bearing member 43. The shaft hole 61 includes a first shaft hole 61*a* that is a through hole formed in the first bearing member 43*a*, as shown in FIGS. 6A and 6B, and a second shaft hole 61*b* that is a non-through hole formed in the second bearing member 43*b*, as shown in FIGS. 7A and 7B. FIG. 6A is a plan view of the first bearing member 43*a*, and FIG. 6B is a sectional view taken along a line VI-VI in FIG. 6A. FIG. 7A is a bottom view of the second bearing member 43*b*, and FIG. 7B is a sectional view taken along a line VII-VII in FIG. 7A.

As shown in FIG. 6B, the first bearing member 43*a* is fitted in the second portion 54 of the shaft portion 51. The first bearing member 43*a* is formed into a columnar shape having a constant outer diameter from one end to the other end in the axial direction of the driving shaft 42. The outer diameter of the first bearing member 43*a* is a dimeter at which the first bearing member 43*a* can be press-fitted in the second portion 54 of the shaft portion 51. The first shaft hole 61*a* is formed at the shaft center portion of the first bearing member 43*a*. Details of the first shaft hole 61*a* will be explained later.

The second bearing member 43*b* is formed into a columnar shape. The second bearing member 43*b* includes a large-diameter portion 62 equal in outer diameter to the first bearing member 43*a*, and the small-diameter portion 63 smaller in outer diameter than the large-diameter portion 62. The large-diameter portion 62 is fitted in the second portion 54. The outer diameter of the large-diameter portion 62 is a diameter at which the large-diameter portion 62 can be press-fitted in the second portion 54. The second shaft hole 61*b* is formed at the shaft center portion of the second bearing member 43*b*. Details of the second shaft hole 61*b* will be explained later.

The sum of the length of the first bearing member 43*a* in the axial direction and the length of the large-diameter portion 62 of the second bearing member 43*b* in the axial direction is equal to the length of the second portion 54 of the shaft portion 51 in the axial direction. The first bearing member 43*a* and the large-diameter portion 62 of the second bearing member 43*b* are press-fitted in the second portion 54, and the latch members 56 and 57 are assembled into the first portion 53. As a result, the large-diameter portion 62 of the second bearing member 43*b* comes into contact with the end face 58 at the boundary between the second portion 54 and third portion 55 of the shaft portion 51, and the first and second bearing members 43*a* and 43*b* are held between the latch members 56 and 57 and the end face 58.

The small-diameter portion 63 of the second bearing member 43*b* is formed into a shape reaching the second end portion 51*b* of the shaft portion 51 in the axial direction of the driving shaft 42. That is, as shown in FIG. 2, the small-diameter portion 63 is inserted in the opening 55*a* of the third portion 55 of the shaft portion 51 and passes through the third portion 55 in the axial direction of the driving shaft 42.

The outer diameter of the small-diameter portion 63 is a diameter at which the small-diameter portion 63 can be inserted in the opening 55*a* of the third portion 55 in a loosely fitted state. Therefore, as shown in FIG. 5A, an annular gap d viewed from the axial direction of the driving shaft 42 is formed between the inner surface of the opening 55*a* and the outer surface of the small-diameter portion 63 of the second bearing member 43*b*. When press-fitting the large-diameter portion 62 of the second bearing member 43*b* in the shaft portion 51 (second portion 54), the small-diameter portion 63 contacts the second end portion 51*b* of the shaft portion 51 and does not receive an external force from the second end portion 51*b*.

As shown in FIGS. 6A and 6B, the first bearing member 43*a* includes an inner end face 64 facing the second bearing member 43*b*, and a first circular recessed portion 65 is formed in the inner end face 64. As shown in FIGS. 7A and 7B, the second bearing member 43*b* includes an inner end face 66 facing the first bearing member 43*a*, and a second circular recessed portion 67 is formed in the inner end face 66. The first circular recessed portion 65 and the second circular recessed portion 67 are formed into a circular shape viewed from the axial direction of the driving shaft 42, and are positioned on the same axis as that of the shaft hole 61. The first circular recessed portion 65 and the second circular recessed portion 67 have the same opening diameter and are superimposed on each other so that their opening portions face each other. By superimposing the first circular recessed portion 65 and the second circular recessed portion 67 to face each other, an oil reservoir 68 is formed from a space communicating with the shaft hole 61. The oil reservoir 68 is filled with a lubricating oil (not shown).

As shown in FIG. 6B, the first shaft hole 61*a* of the first bearing member 43*a* includes a first large-diameter hole 71 open in the first circular recessed portion 65, and a first small-diameter hole 72 open in an end portion of the first bearing member 43*a* close to the crank body 41. The hole diameter of the first small-diameter hole 72 is a diameter at which the driving shaft 42 can rotatably slide. The hole diameter of the first large-diameter hole 71 is larger than that of the first small-diameter hole 72 and is a diameter at which an annular space S1 is formed between the first large-diameter hole 71 and the driving shaft 42. The annular space S1 constitutes a first oil passage 73 for supplying a lubricating oil in the first circular recessed portion 65 (oil reservoir 68) from the first circular recessed portion 65 to the first small-diameter hole 72 positioned in the axial direction of the driving shaft 42. The first oil passage 73 is formed all over the first shaft hole 61*a* (shaft hole 61) in the circumferential direction.

As shown in FIG. 7B, the second shaft hole 61*b* of the second bearing member 43*b* includes a second large-diameter hole 74 open in the second circular recessed portion 67, and a second small-diameter hole 75 formed in the small-diameter portion 63 of the second bearing member 43*b*. The second small-diameter hole 75 is a non-through hole. The hole diameter of the second small-diameter hole 75 is a diameter at which the driving shaft 42 can rotatably slide. The hole diameter of the second large-diameter hole 74 is larger than that of the second small-diameter hole 75 and is a diameter at which an annular space S2 is formed between the second large-diameter hole 74 and the driving shaft 42. The annular space S2 constitutes a second oil passage 76 for supplying a lubricating oil in the second circular recessed portion 67 (oil reservoir 68) from the second circular recessed portion 67 to the second small-diameter hole 75 positioned in the axial direction of the driving shaft 42. The second oil passage 76 is formed all over the second shaft hole 61*b* (shaft hole 61) in the circumferential direction.

The crank body 41 and the driving body 44 are formed from a plastic material. The driving shaft 42 is formed from a metal material. The driving body 44 according to the embodiment does not contact the driving shaft 42, thus need not be formed from a material capable of supporting a sliding component, and is formed from a material having minimum wear resistance and rigidity. The bearing member 43 can slidably support the rotating driving shaft 42, and is formed from a plastic material having oil resistance.

Operation of Diaphragm Pump

In the diaphragm pump 11 having the above-described structure, the rotating shaft 14 of the motor 12 rotates to rotate the crank body 41 and the driving shaft 42 about the rotating shaft 14. At this time, the rotation of the driving body 44 is interfered by the diaphragm 17, and the driving body 44 swings along with a change of the direction in which the driving shaft 42 is inclined. By the swing, each arm portion 52 pushes and pulls the deformation portion 21 of the diaphragm 17. The driving body 44 converts the rotation of the rotating shaft 14 into a reciprocating motion, and transfers the reciprocating motion to the deformation portion 21 of the diaphragm 17.

As the deformation portion 21 is pulled by the arm portion 52 toward the motor 12 and increases, the volume of the pump chamber 22 to open the suction valve 24 and suck air from the suction pipe 27 into the pump chamber 22 through the suction passage 25. On the other hand, as the deformation portion 21 of the diaphragm 17 is pushed by the arm portion 52 toward the valve holder 18, the deformation portion 21 contracts and the volume of the pump chamber 22 decreases to open the exhaust valve 34 and exhaust the air in the pump chamber 22 from the exhaust pipe 33 through the exhaust passage 26. The crank body 41 continuously rotates to cause the pump mechanism 36 to alternately repeat a state in which air is exhausted from the pump chamber 22 and a state in which air is sucked into the pump chamber 22.

When the diaphragm pump 11 operates in this manner, the driving shaft 42 rotates while coming into contact with the first small-diameter hole 72 of the first bearing member 43*a* and the second small-diameter hole 75 of the second bearing member 43*b*. That is, the driving shaft 42 slides with respect to the shaft hole 61.

The oil reservoir 68 is open in the shaft hole 61. The lubricating oil in the oil reservoir 68 flows through the first and second oil passages 73 and 76 formed from small gaps between the driving shaft 42 and the first and second large-diameter holes 71 and 74, reaches the first and second small-diameter holes 72 and 75, and lubricates them. Hence, the lubricating oil can be supplied from the oil reservoir 68 to the first and second small-diameter holes 72 and 75.

In the embodiment, the driving body 44 does not include a shaft hole in which the driving shaft 42 is rotatably fitted. Coaxial adjustment, which has conventionally been executed, need not be executed on the mold for molding the driving body 44. The coaxial adjustment is executed on molds for molding the first bearing member 43*a* and the second bearing member 43*b*. By executing the coaxial adjustment, the outer diameters of the first bearing member 43*a* and second bearing member 43*b* are determined. To fit the outer diameter, work of adjusting the inner diameter of the second portion 54 of the driving body 44 is executed on the mold for molding the driving body 44. The adjustment work requires high accuracy equal to the conventional one. However, the embodiment can be adopted to decrease the labor of mold processing and inspection in mold formation and remodeling/modification.

The first and second bearing members 43*a* and 43*b* according to the embodiment are formed separately from the driving body 44, and are not influenced by a sink mark generated at the arm portions 52 at the time of molding the driving body 44. The circularity of the first small-diameter hole 72 of the first bearing member 43*a* and the second small-diameter hole 75 of the second bearing member 43*b* can be kept high. A clearance between the first and second small-diameter holes 72 and 75 and the driving shaft 42 can be ensured, an oil film can be continuously generated, and the wear resistance of the shaft hole 61 is improved.

According to the embodiment, there can be provided the diaphragm pump 11 in which the adjustment work executed on the mold for molding the driving body 44 is simplified and the wear resistance of the bearing portion is improved.

The oil reservoir 68 according to the embodiment is formed by the first circular recessed portion 65 formed in the inner end face 64 of the first bearing member 43*a*, and the second circular recessed portion 67 formed in the inner end face 66 of the second bearing member 43*b*. The shaft hole 61 includes the first and second oil passages 73 and 76 formed so that the lubricating oil in the first and second circular recessed portions 65 and 67 flows from the first and second circular recessed portions 65 and 67 in the axial direction. The lubricating oil can be supplied to the first and second small-diameter holes 72 and 75 to lubricate the sliding portion between the driving shaft 42 and the first and second bearing members 43*a* and 43*b*. Although the diaphragm pump 11 includes the two bearing members (first bearing member 43*a* and second bearing member 43*b*), the bearing portion can be reliably lubricated.

The arm portion 52 of the driving body 44 according to the embodiment is formed integrally with the second end portion 51*b* of the shaft portion 51. The second bearing member 43*b* is formed into a shape reaching the second end portion 51*b* in the axial direction of the driving shaft 42. The annular gap d viewed from the axial direction of the driving shaft 42 is formed between the opening 55*a* formed at the second end portion 51*b* and the second bearing member 43*b*.

Thus, even if the large-diameter portion 62 of the second bearing member 43*b* is press-fitted in the second portion 54 of the shaft portion 51, no load is applied from the shaft portion 51 to the small-diameter portion 63. Even if the second end portion 51*b* of the shaft portion 51 is deformed under the influence of a sink mark generated at the arm portion 52 of the driving body 44 at the time of molding, the deformation is absorbed by the annular gap d, and no press force is applied from the end portion of the shaft portion 51 to the second bearing member 43*b*. The circularity of the small-diameter portion 63 of the second bearing member 43*b* can be kept higher, and the wear resistance of the second bearing member 43*b* can be further improved.

Modification of Oil Passage

Figure 8A:
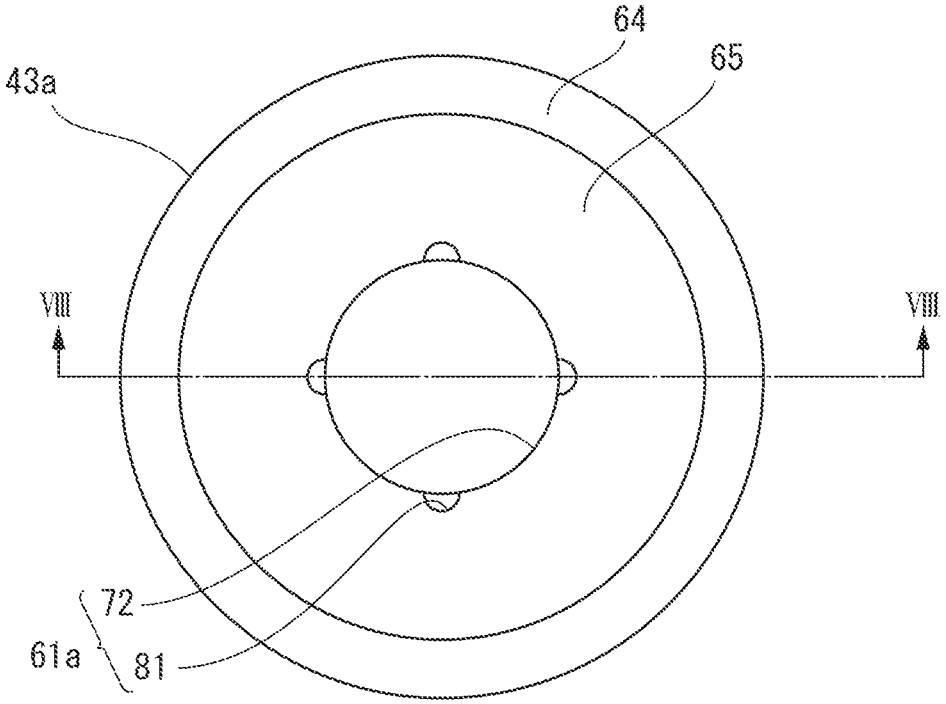
FIG. 8A is a plan view showing a modification of the first bearing member.
Figure 8B:
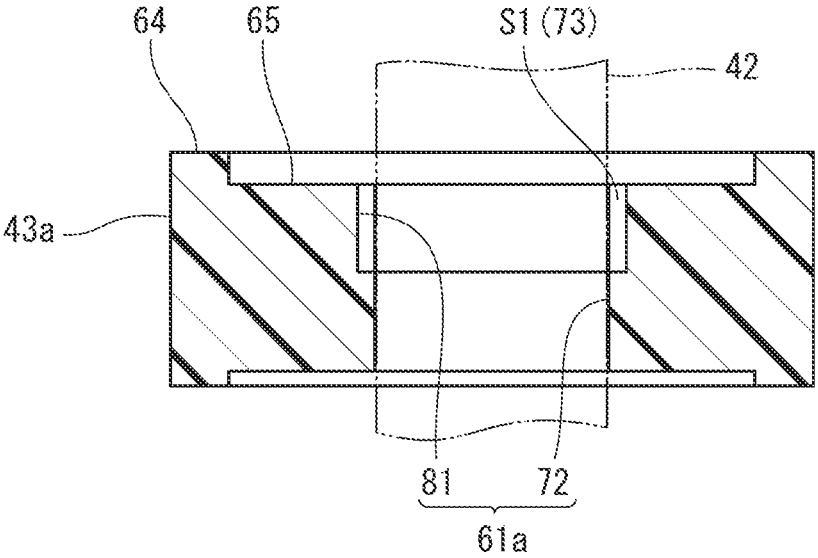
FIG. 8B is a sectional view of the first bearing member shown in FIG. 8A.
Figure 9A:
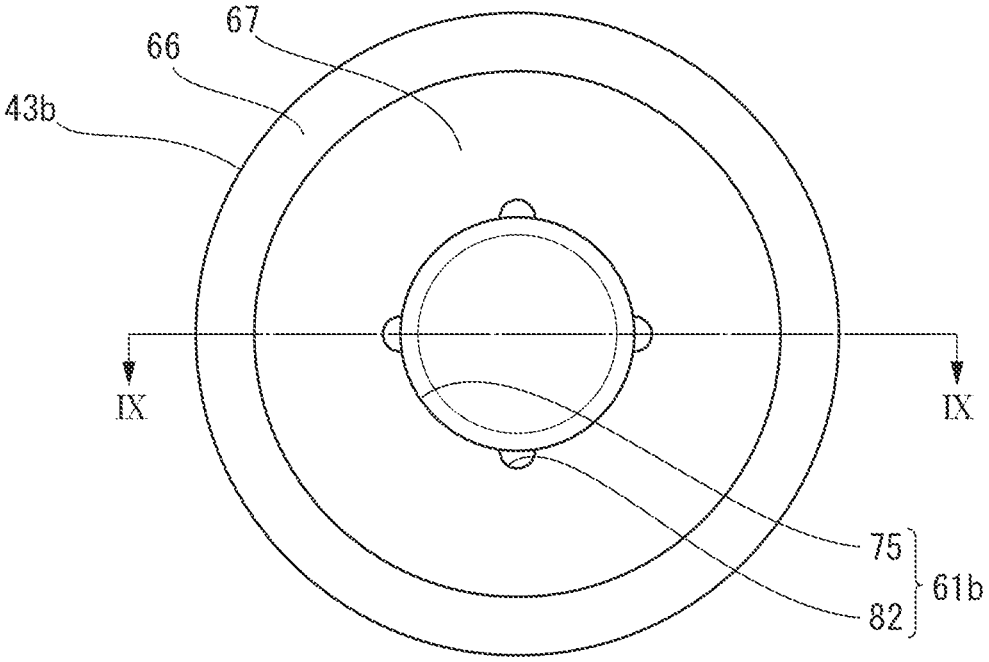
FIG. 9A is a bottom view showing a modification of the second bearing member.
Figure 9B:
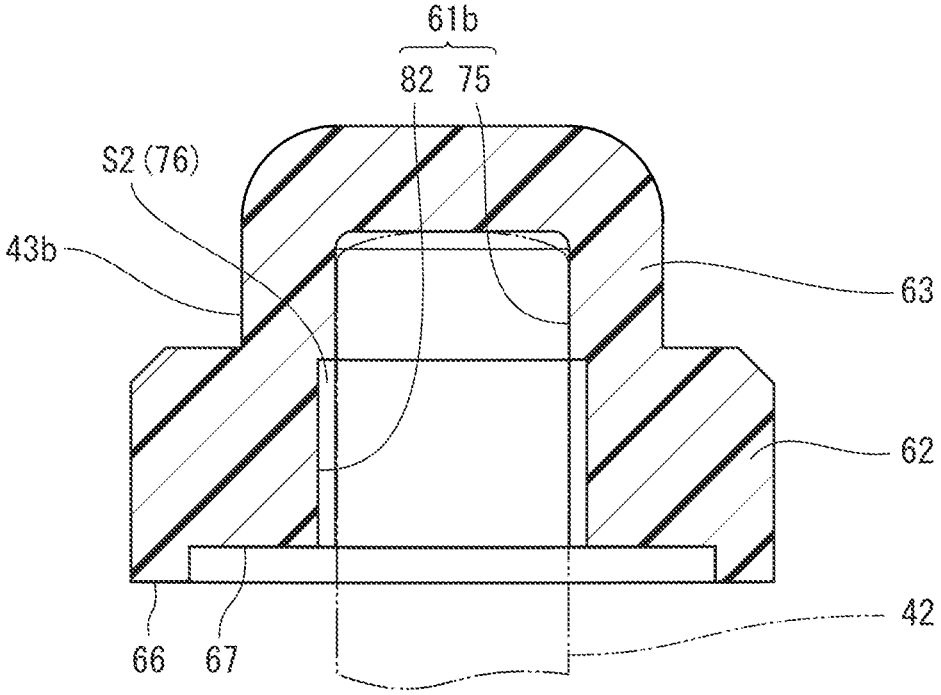
FIG. 9B is a sectional view of the second bearing member shown in FIG. 9A.
Figure 10:
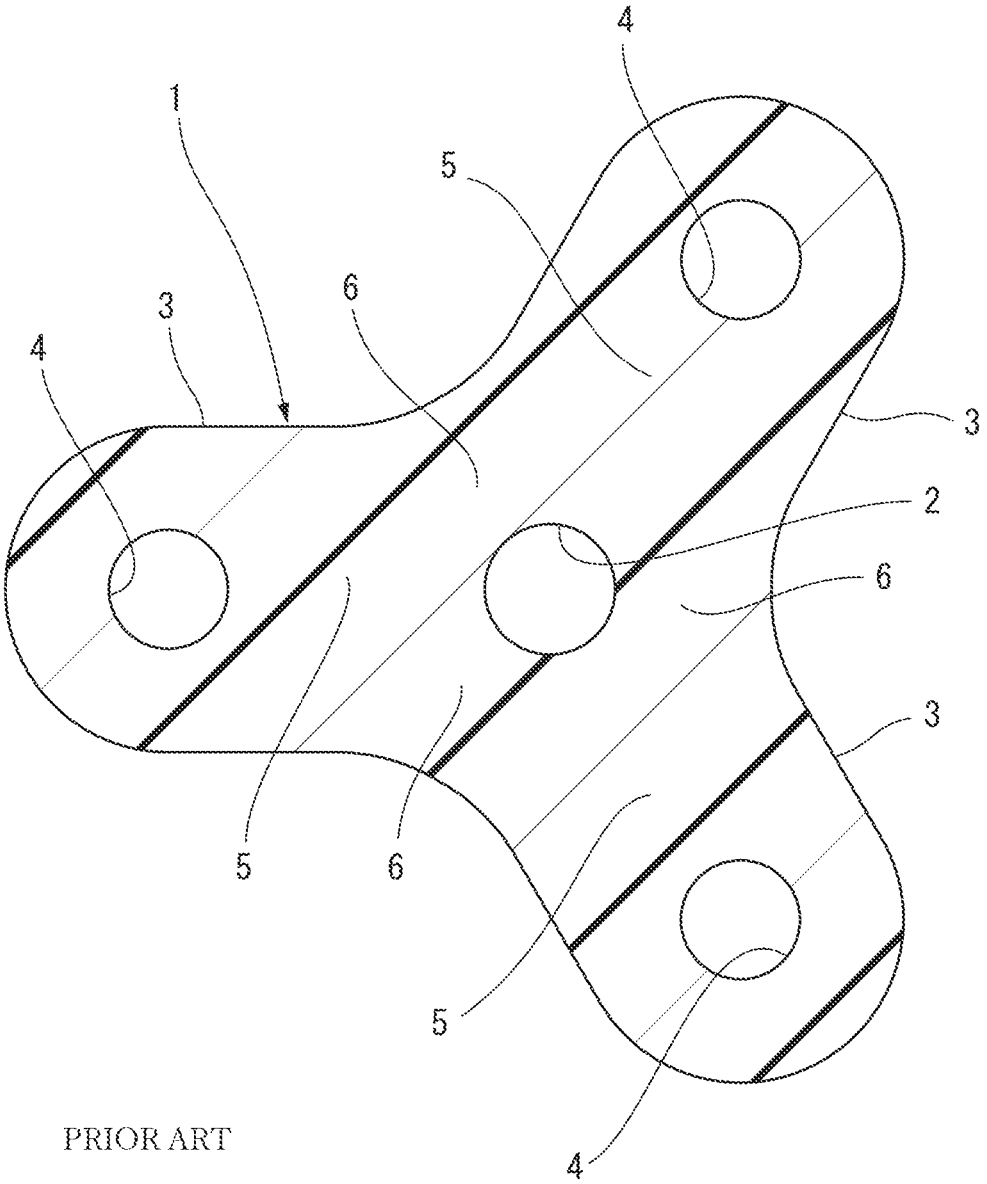
FIG. 10 is a sectional view of a conventional driving body.

The oil passage can also be constituted as shown in FIGS. 8A to 9B. In FIGS. 8A to 9B, the same reference numerals as those in FIGS. 1 to 7B denote the same or similar parts, and a detailed description thereof will be omitted. FIG. 8A is a plan view of a modification of the first bearing member 43*a*, and FIG. 8B is a sectional view taken along a line VIII-VIII in FIG. 8A. FIG. 9A is a bottom view of a modification of the second bearing member 43*b*, and FIG. 9B is a sectional view taken along a line IX-IX in FIG. 9A.

The first shaft hole 61*a* shown in FIGS. 8A and 8B includes a first oil passage 81 constituted by a plurality of grooves extending in the axial direction of the driving shaft 42 from the first circular recessed portion 65 (oil reservoir 68) toward the inside of the first bearing member 43*a*. The second shaft hole 61*b* shown in FIGS. 9A and 9B includes a second oil passage 82 constituted by a plurality of grooves extending in the axial direction of the driving shaft 42 from the second circular recessed portion 67 (oil reservoir 68) toward the inside of the second bearing member 43*b*. The plurality of grooves constituting the first oil passage 81 and the plurality of grooves constituting the second oil passage 82 are aligned at a predetermined interval in the circumferential direction of the driving shaft 42. Portions where no groove (first and second oil passages 81 and 82) is formed in the first shaft hole 61*a* and the second shaft hole 61*b* are sliding surfaces on which the driving shaft 42 rotatably slides. Even if the oil passages 81 and 82 are constituted in this way, the bearing portion of the driving shaft 42 can be reliably lubricated.

The shaft hole 61 in the above-described embodiment includes the first oil passage 73 or 81 and the second oil passage 76 or 82, and is formed to guide the lubricating oil from the oil reservoir 68 in two directions (for example, both up and down) in the axial direction of the driving shaft 42. However, the diaphragm pump 11 can employ a structure in which the lubricating oil is guided from the oil reservoir 68 in one direction (for example, up or down) in the axial direction of the driving shaft 42. That is, the oil reservoir 68 can be formed by a circular recessed portion formed in either one of the inner end face 64 of the first bearing member 43*a* and the inner end face 66 of the second bearing member 43*b*. The oil passage of the shaft hole 61 can be formed to extend from the first and second circular recessed portions 65 and 67 in only one direction (for example, up) or the other direction (for example, down) in the axial direction of the driving shaft 42.

The diaphragm pump 11 according to the above-described embodiment is a three-cylinder diaphragm pump including the three pump chambers 22. However, the number of cylinders of the diaphragm pump 11 can be properly changed into a single cylinder, two cylinders, four or more cylinders, or the like.

EXAMPLE

A diaphragm pump according to an example of the present invention includes a diaphragm including a deformation portion constituting part of a wall of a pump chamber, a crank body fixed to a rotating shaft of a motor, a driving shaft that is fixed at an eccentric position of the crank body and inclined, a driving body that is rotatably supported by the driving shaft via a bearing member and configured to convert a rotation of the crank body into a reciprocating motion and transfer the reciprocating motion to the deformation portion, and a pump mechanism configured to alternately repeat a state in which a fluid is exhausted from the pump chamber and a state in which the fluid is sucked into the pump chamber along with the reciprocating motion of the driving body, the driving body including a shaft portion configured to store and hold the bearing member in a fitted state, and an arm portion that projects outward in a radial direction from the shaft portion and is connected to the deformation portion, and the bearing member including a first bearing member and a second bearing member superimposed on each other in a state in which the first bearing member and the second bearing member are aligned in an axial direction of the driving shaft, the first bearing member being closer to the crank body than the second bearing member, a shaft hole configured to rotatably fit the driving shaft, the shaft hole including a through hole formed in the first bearing member and a non-through hole formed in the second bearing member, and an oil reservoir formed at a boundary between the first bearing member and the second bearing member.

According to the example, a shaft hole in which the driving shaft is rotatably fitted need not be provided in the driving body. Adjustment work executed on the mold for molding the driving body is only work of adjusting the inner diameter of a portion in which the bearing member is fitted. The first and second bearing members are formed separately from the arm portions of the driving body, and are not influenced by a sink mark generated at the time of molding the driving body. Therefore, the circularity of the shaft holes formed in the first and second bearing members can be kept high. According to the embodiment, there can be provided the diaphragm pump in which the adjustment work executed on the mold for molding the driving body is simplified and the wear resistance of the bearing portion is improved.

The direction in which the driving shaft is inclined is a direction in which the eccentric amount of the end portion of the driving shaft inserted in the shaft hole of the bearing member with respect to the rotating shaft decreases.

The first bearing member and the second bearing member may be formed into a columnar shape.

The oil reservoir may be open all over the shaft hole in a circumferential direction. The oil reservoir may be open in a partial region of the shaft hole in the circumferential direction.

The first bearing member may include a first end face facing the second bearing member, the second bearing member may include a second end face facing the first bearing member, and the oil reservoir may include a circular recessed portion formed in at least one of the first end face and the second end face.

In the first example of the shaft hole, the shaft hole further includes a small-diameter hole having a diameter at which the driving shaft is slidable, and a large-diameter hole that is open in the circular recessed portion and has a diameter larger than the diameter of the small-diameter hole.

In the second example of the shaft hole, the shaft hole further includes a plurality of grooves extending in the axial direction from the circular recessed portion.

In the third example of the shaft hole, the shaft hole further includes an oil passage formed to supply a lubricating oil in the oil reservoir from the oil reservoir in the axial direction. The oil passage may be formed all over the shaft hole in the circumferential direction. Alternatively, the oil passage may include a plurality of grooves extending in the axial direction from the oil reservoir.

The shaft portion may include a first end portion, and a second end portion spaced apart from the crank body in comparison with the first end portion. In this case, the arm portion is connected to the second end portion. The second end portion includes an opening in which the second bearing member is inserted. An annular gap is formed between an inner surface of the opening and an outer surface of the second bearing member.

The shaft portion may further include a first portion including the first end portion, a second portion configured to store the bearing member in the fitted state, and a third portion including the second end portion. The second portion is arranged between the first portion and the third portion. The first portion may be configured to store a latch member configured to prevent the bearing member from detaching from the second portion to the first portion.

An inner diameter of the opening included in the third portion may be smaller than an inner diameter of the second portion, and the third portion may include, at a boundary between the second portion and the third portion, an end face substantially orthogonal to an axis of the driving shaft. An angle defined by the axis of the driving shaft and the end face may not be 90°. Further, the inner diameter of the second portion may be smaller than the inner diameter of the first portion.

The second bearing member may include a large-diameter portion configured to fit in the second portion, and a small-diameter portion configured to be inserted in the opening included in the third portion and to form the annular gap between the inner surface of the opening and an outer surface of the small-diameter portion. The outer diameter of the small-diameter portion is smaller than the outer diameter of the large-diameter portion. The outer diameter of the small-diameter portion is smaller than the inner diameter of the opening by a length equivalent to the annular gap.

The arm portion of the driving body may be formed integrally with the second end portion of the shaft portion. The second bearing member may be formed into a shape reaching the second end portion of the shaft portion in the axial direction of the driving shaft. An annular gap viewed from the axial direction of the driving shaft may be formed between the second end portion of the shaft portion and the second bearing member.

What is claimed is:

1. A diaphragm pump comprising:

a diaphragm including a deformation portion constituting part of a wall of a pump chamber;

a crank body fixed to a rotating shaft of a motor;

a driving shaft that is fixed at an eccentric position of the crank body and inclined;

a driving body that is rotatably supported by the driving shaft via a bearing and configured to convert a rotation of the crank body into a reciprocating motion and transfer the reciprocating motion to the deformation portion; and a pump mechanism configured to alternately repeat a state in which a fluid is exhausted from the pump chamber and a state in which the fluid is sucked into the pump chamber along with the reciprocating motion of the driving body, the driving body including:

a shaft portion configured to store and hold the bearing in a fitted state; and an arm portion that projects outward in a radial direction from the shaft portion and is connected to the deformation portion, and the bearing including:

a first bearing and a second bearing superimposed on each other in a state in which the first bearing and the second bearing are aligned in an axial direction of the driving shaft, the first bearing being closer to the crank body than the second bearing, wherein the first bearing and the second bearing are separated;

a shaft hole configured to rotatably fit the driving shaft, the shaft hole including a through hole formed in the first bearing and a non-through hole formed in the second bearing; and an oil reservoir formed at a boundary between the first bearing and the second bearing.

2. The pump according to claim 1, wherein the oil reservoir is open all over the shaft hole in a circumferential direction.

3. The pump according to claim 1, wherein the first bearing includes a first end face facing the second bearing, the second bearing includes a second end face facing the first bearing, and the oil reservoir includes a circular recessed portion formed in at least one of the first end face and the second end face.

4. The pump according to claim 3, wherein the shaft hole further includes:

a small-diameter hole having a diameter at which the driving shaft is slidable; and a large-diameter hole that is open in the circular recessed portion and has a diameter larger than the diameter of the small-diameter hole.

5. The pump according to claim 3, wherein the shaft hole further includes a plurality of grooves extending in the axial direction from the circular recessed portion.

6. The pump according to claim 3, wherein the first end face and the second end face are configured to contact with each other except for the oil reservoir.

7. The pump according to claim 1, wherein the shaft hole further includes an oil passage formed to supply a lubricating oil in the oil reservoir from the oil reservoir in the axial direction.

8. The pump according to claim 7, wherein the oil passage is formed all over the shaft hole in the circumferential direction.

9. The pump according to claim 8, wherein the oil passage includes a plurality of grooves extending in the axial direction from the oil reservoir.

10. A diaphragm pump comprising:

a diaphragm including a deformation portion constituting part of a wall of a pump chamber;

a crank body fixed to a rotating shaft of a motor;

a driving shaft that is fixed at an eccentric position of the crank body and inclined;

a driving body that is rotatably supported by the driving shaft via a bearing and configured to convert a rotation of the crank body into a reciprocating motion and transfer the reciprocating motion to the deformation portion; and a pump mechanism configured to alternately repeat a state in which a fluid is exhausted from the pump chamber and a state in which the fluid is sucked into the pump chamber along with the reciprocating motion of the driving body, the driving body including:

a shaft portion configured to store and hold the bearing in a fitted state; and an arm portion that projects outward in a radial direction from the shaft portion and is connected to the deformation portion, and the bearing including:

a first bearing and a second bearing superimposed on each other in a state in which the first bearing and the second bearing are aligned in an axial direction of the driving shaft, the first bearing being closer to the crank body than the second bearing;

a shaft hole configured to rotatably fit the driving shaft, the shaft hole including a through hole formed in the first bearing and a non-through hole formed in the second bearing; and an oil reservoir formed at a boundary between the first bearing and the second bearing, wherein the shaft portion includes a first end portion, and a second end portion spaced apart from the crank body in comparison with the first end portion, the arm portion is connected to the second end portion, the second end portion includes an opening in which the second bearing is inserted, and an annular gap is formed between an inner surface of the opening and an outer surface of the second bearing.

11. The pump according to claim 10, wherein the shaft portion further includes:

a first portion including the first end portion;

a second portion configured to store the bearing in the fitted state; and a third portion including the second end portion, the second portion is arranged between the first portion and the third portion, and the first portion is configured to store a latch member configured to prevent the bearing from detaching from the second portion to the first portion.

12. The pump according to claim 11, wherein an inner diameter of the opening included in the third portion is smaller than an inner diameter of the second portion, and the third portion includes, at a boundary between the second portion and the third portion, an end face substantially orthogonal to an axis of the driving shaft.

13. The pump according to claim 12, wherein the second bearing includes:

a large-diameter portion configured to fit in the second portion; and a small-diameter portion configured to be inserted in the opening included in the third portion and to form the annular gap between the inner surface of the opening and an outer surface of the small-diameter portion.

* * * * *